US008763533B2

(12) United States Patent
Prelic et al.

(10) Patent No.: US 8,763,533 B2
(45) Date of Patent: Jul. 1, 2014

(54) ACTIVE BODY

(75) Inventors: Nenad Prelic, Anger (DE); Vikorn Martin Kadavanich, Bayerisch Gmain (DE); Rainer Gaisbauer, Schönau (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 0 days.

(21) Appl. No.: 13/337,692

(22) Filed: Dec. 27, 2011

(65) Prior Publication Data

US 2012/0174812 A1 Jul. 12, 2012

Related U.S. Application Data

(63) Continuation-in-part of application No. PCT/EP2010/003567, filed on Jun. 15, 2010.

(30) Foreign Application Priority Data

Jun. 26, 2009 (DE) ..... 10 2009 030 869

(51) Int. Cl.
*F42B 4/26* (2006.01)
*F42B 5/15* (2006.01)
*F42B 12/42* (2006.01)

(52) U.S. Cl.
USPC ..... 102/345; 102/336

(58) Field of Classification Search
USPC ..... 102/334, 342, 345, 351, 352, 357, 360, 102/364
See application file for complete search history.

(56) References Cited

U.S. PATENT DOCUMENTS

| | | | |
|---|---|---|---|
| 2,787,217 | A | 3/1953 | Mahaffie |
| 2,678,603 | A | 5/1954 | Prince, Jr. et al. |
| 3,216,410 | A | 11/1965 | Trombatore et al. |
| 3,628,416 | A | 12/1971 | Kernan |
| 3,760,729 | A | 9/1973 | Freeman |

(Continued)

FOREIGN PATENT DOCUMENTS

| | | | |
|---|---|---|---|
| CA | 2146015 | A1 | 2/1995 |
| DE | 649 530 | C | 8/1937 |

(Continued)

OTHER PUBLICATIONS

International Search Report and IPRP issued in PCT/EP2010/003565, completed Aug. 31, 2010 and mailed Sep. 7, 2010.

(Continued)

*Primary Examiner* — James Bergin
(74) *Attorney, Agent, or Firm* — Griffin & Szipl, P.C.

(57) ABSTRACT

An active body (1) is proposed that has, as active mass (5), multiple flares (2, 3) arranged behind each other or stacked, in particular for the generation of decoys, wherein the flares (2, 3) are NC (nitrocellulose) and RP (red phosphorus) single flares. The single flares (2, 3) are evenly or unevenly stacked in succession such that one RP single flare (3) lies on an NC single flare (2), or multiple NC single flares (2) or multiple RP single flares (3) follow each other, so that it is possible to vary the percentage of NC and RP in the active body (1) from about 0% to about 100%. A container (4) houses the active mass (5), and can in turn have predetermined breaking points (7) to facilitate the break up of the active body (1).

23 Claims, 3 Drawing Sheets

(56) References Cited

U.S. PATENT DOCUMENTS

| | | | | |
|---|---|---|---|---|
| 4,002,122 | A | 1/1977 | Gould | |
| 4,060,435 | A | 11/1977 | Schroeder | |
| 4,068,591 | A | 1/1978 | Betts | |
| 4,096,804 | A | 6/1978 | Bilsbury | |
| 4,374,494 | A | 2/1983 | Maury | |
| 4,409,898 | A | 10/1983 | Blix et al. | |
| 4,624,186 | A | 11/1986 | Widera et al. | |
| 4,838,167 | A | 6/1989 | Prahauser et al. | |
| H0000778 | H | 5/1990 | Carlton et al. | |
| 5,074,216 | A | 12/1991 | Dunne et al. | |
| 5,635,666 | A | 6/1997 | Bannasch et al. | |
| 5,929,369 | A | 7/1999 | Bissig et al. | |
| 5,992,327 | A * | 11/1999 | Wardecki et al. | 102/334 |
| 6,055,909 | A | 5/2000 | Sweeny | |
| 6,427,599 | B1 | 8/2002 | Posson et al. | |
| 6,513,438 | B1 | 2/2003 | Fegg et al. | |
| 6,659,012 | B1 | 12/2003 | Grassi et al. | |
| 6,666,351 | B1 | 12/2003 | Hartz et al. | |
| 7,343,861 | B1 | 3/2008 | Baker | |
| 7,363,861 | B2 | 4/2008 | Brune et al. | |
| 7,421,950 | B2 | 9/2008 | Dillard et al. | |
| 7,516,700 | B1 | 4/2009 | Callaway | |
| 7,584,702 | B1 | 9/2009 | Sutherland et al. | |
| 7,866,265 | B1 | 1/2011 | Kravel et al. | |
| 7,992,496 | B2 | 8/2011 | Dillard et al. | |
| 8,146,504 | B2 | 4/2012 | Wallner et al. | |
| 8,276,518 | B2 | 10/2012 | Dillard et al. | |
| 2002/0011173 | A1 | 1/2002 | Schildknecht et al. | |
| 2003/0116050 | A1 | 6/2003 | Brum et al. | |
| 2004/0139876 | A1 | 7/2004 | Wilson et al. | |
| 2004/0244626 | A1 | 12/2004 | Ehmig | |
| 2006/0032391 | A1 | 2/2006 | Brune et al. | |
| 2006/0201372 | A1 | 9/2006 | Nicolae | |
| 2007/0039505 | A1 | 2/2007 | Dillard et al. | |
| 2009/0007768 | A1 | 1/2009 | Wallner et al. | |
| 2009/0095186 | A1 | 4/2009 | Dillard et al. | |
| 2009/0301336 | A1 | 12/2009 | Wardercki et al. | |
| 2010/0288111 | A1 | 11/2010 | Kunz | |
| 2011/0146520 | A1 | 6/2011 | Guth | |
| 2011/0174182 | A1 | 7/2011 | Guth et al. | |
| 2012/0137913 | A1 | 6/2012 | Prelic et al. | |
| 2012/0160121 | A1 | 6/2012 | Prelic et al. | |

FOREIGN PATENT DOCUMENTS

| | | | |
|---|---|---|---|
| DE | 2359758 | C1 | 7/1988 |
| DE | 94 14 263 | U1 | 10/1994 |
| DE | 197 56 204 | C1 | 3/1999 |
| DE | 199 10 074 | A1 | 9/2000 |
| DE | 199 51 767 | A1 | 5/2001 |
| DE | 103 23 531 | B3 | 2/2005 |
| DE | 10 2005 020 159 | A1 | 11/2006 |
| DE | 10 2006 004 912 | A1 | 7/2007 |
| DE | 196 49 892 | A1 | 7/2008 |
| DE | 10 2007 032 112 | A1 | 1/2009 |
| DE | 10 2009 020 558 | A1 | 11/2010 |
| DE | 10 2009 030 868 | A1 | 1/2011 |
| EP | 0 204 115 | A2 | 12/1986 |
| FR | 715 614 | A | 12/1931 |
| GB | 250 271 | A | 10/1926 |
| JP | 11-173796 | A | 7/1999 |
| WO | 00/19164 | A1 | 4/2000 |
| WO | 2007/087948 | A1 | 8/2007 |
| WO | 20101003496 | A1 | 1/2010 |
| WO | 20101019291 | A1 | 12/2010 |

OTHER PUBLICATIONS

International Search Report and IPRP issued in PCT/EP2010/003566, completed Aug. 27, 2010 and mailed Sep. 7, 2010.

International Search Report and IPRP issued in PCT/EP2010/003567, completed Sep. 16, 2010 and mailed Sep. 22, 2010.

International Search Report issued in co-pending related application PCT/EP2009/004113, completed Sep. 29, 2009 and mailed Oct. 6, 2009.

International Search Report issued in co-pending related application PCT/EP2009/004114, completed Oct. 1, 2009 and mailed Oct. 13, 2009.

International Search Report issued in co-pending related application PCT/EP2010/002332, completed Jun. 29, 2010 and mailed Jul. 6, 2010.

McGraw-Hill Dictionary of Scientific and Technical Terms (Sixth Ed.) 814 (2003).

"United States Naval Pyrotechnical Compositions," at http://www.google.com/urlsa=t&rct=j&q=&esrc=s&source=web&cd=9&ved=0CGYQFjAI&url=http%3A%2F%2Fwww.am-munitionpages.com%2Fdownload%2F237%2FUS%2520navy%2520pyrotechnics pdf&ei=zjI6UsagMLXi4AOnw4Fw&usg=AFQjCNGhmQURaXkLjZAoI124I0jajOvmIg&sig2=vw04ff4-VMe_PYiiD8aZzw&bvm=bv.52434380,d.dmg (downloaded Sep. 18, 2013, five pages).

S.M. Danali et al., Developments in Pyrotechnics, 60 Defense Science Journal 152-158 (2010).

Clarence W. Gilliam et al., Flare, Igniter and Pyrotechnic Disposal: Red Phosphorous Smokes, Naval Ammunition Depot, AD-A013 182 (1975).

"Pyrotechnic Chemistry," at http://www.islandgroup.com/military/pyrotechnic_chemistry.php (2013)(downloaded Sep. 18, 2013, two pages).

Charles A. Knapp, New Infrared Flare and High-altitude Igniter Compositions, Feltman Research and Engineering Laboratories, Picatany Arsenal (1959).

Rui Shu, Explosive Chemistry: The History and Chemistry of Explosives, Dartmouth Undergraduate Journal of Science 21-23 (2012).

Gao Guangyan, Nitrocellulose Synthesis Outline, at http://www.loneoceans.com/labs/nitrocellulose/ (2012).

Random House Webster's College Dictionary 506 (1991).

Office Action issed in co-pending related U.S. Appl. No. 13/291,281 on Sep. 5, 2013.

"Stainless Steels," at http://www.dew-stahl.com/fileadmin/files/dew-stahl.com/documents/Publikationen/ Broschueren/015_DEW_RSH_GB.pdf (downloaded Dec. 2, 2013).

Notice of Allowance issued in co-pending related U.S. Appl. No. 13/380,959 on Nov. 26, 2013.

English translation (Jan. 2012) of the Written Opinion of the International Searching Authority in PCT/EP2010/003565.

Notice of Allowance issued in co-pending related U.S. Appl. No. 13/380,959 on Aug. 22, 2013.

* cited by examiner

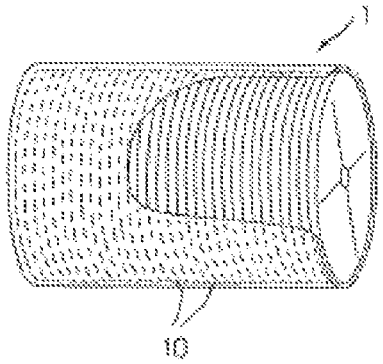
Fig.1
Fig.2
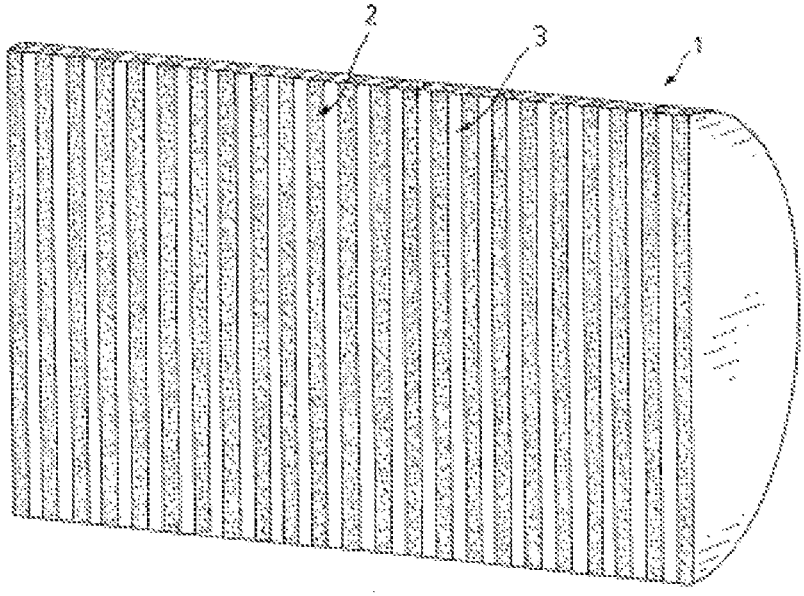

ACTIVE BODY

This is a Continuation-in-Part Application in the United States of International Patent Application No. PCT/EP2010/003567 filed Jun. 15, 2010, which claims priority on German Patent Application No. DE 10 2009 030 869.5, filed Jun. 26, 2009. The entire disclosures of the above patent applications are hereby incorporated by reference.

FIELD OF THE INVENTION

The invention relates to an active body, or active masses, consisting of a plurality of flares, which are arranged or stacked one behind the other, for producing decoy targets.

BACKGROUND OF THE INVENTION

By way of example, an active body such as is described briefly in DE 199 51 767 C2, and, in that case, carries out the task of a dual-mode decoy body. The active mass, which emits radiation in the IR band, ism in that case, formed from flares. A concealment and decoy munition of this type for protection of objects against guided missiles, which contains active substances that form smoke and/or decoy targets, is furthermore disclosed in DE 10 2005 020 159 B4.

Red phosphorus (RP) has already been used in military applications for many decades, for example, in smoke grenades for protection of infantry, artillery and watercraft, or for aircraft decoy targets with an infrared (IR) effect. The smoke or IR effect is produced by the RP by combustion after corresponding ignition by activation. The RP unit is traditionally itself ignited and distributed via an ignition or break-up charge, which ensures that the active body and the active mass are optimally ignited and distributed for the respective purpose, that is to say, that the IR decoy target blooms optimally to form a cloud or a decoy target over an area.

Particularly in conjunction with civil applications in aviation and for marine purposes, ignition and break-up charges, that is to say explosives, are, however, undesirable in bodies or masses such as these, and should not be used. However, dispensing with a break-up charge results in the problem that the IR decoy target cannot bloom in the ideal manner. Correspondingly, new concepts are and were required.

A novel ignition concept such as indicated above, in this direction, is described in more detail in DE 10 2006 004 912 A1. This document discloses a system for protection, in particular, of large flying platforms, such as aircraft, against an IR-guided or radar-guided threat. In this case, the active bodies are preferably activated and ignited without contact. The active bodies are then ejected pneumatically or mechanically. The active bodies themselves are packs without any munitions, which are ignited by means of hot air or a laser.

Building on this idea, the present invention is based on the object of developing an active body of the type described above so as to ensure that the active body and its active masses act reliably in order to form a decoy target.

SUMMARY OF THE INVENTION

The object of the present invention is achieved by the features of a first embodiment, which pertains to an active body (1) having a plurality of flares (2, 3), which are arranged or stacked one behind the other, as an active mass (5), in particular, for production of decoy targets, characterized in that the flares (2, 3) are NC (nitrocellulose) and RP (red phosphorus) individual flares that are stacked uniformly or non-uniformly in their sequence such that an RP individual flare (3) comes to rest on the NC individual flare (2), or a plurality of NC individual flares (2), or a plurality of RP individual flares (3) follow one another, thus making it possible to vary the proportions of NC and RP in the active body (1) from 0% to 100%. Advantageous refinements of the invention are specified in additional embodiments summarized below.

In accordance with a second embodiment of the present invention, the first embodiment is modified so that a container (4) holds the active mass (5). In accordance with a third embodiment of the present invention, the second embodiment is further modified so that the parameters of the container (4) can be adjusted by coloring and/or addition of additives in order to optimize the energy absorption. In accordance with a fourth embodiment of the present invention, the second embodiment or the third embodiment are further modified so that an intermediate layer (6) can be included in the container (4) and the active mass (5). In accordance with a fifth embodiment of the present invention, the fourth embodiment is further modified so that the intermediate layer (6) consists of NC and/or RP granulate. In accordance with a sixth embodiment of the present invention, the second embodiment, the third embodiment, the fourth embodiment and the fifth embodiment are further modified so that additional weak points (7) are provided in the container (4).

The invention is based on the idea of constructing the munitions-free IR decoy target concept based on NC (nitrocellulose) and/or RP (red phosphorus), and in this case varying the proportions of NC/RP (i.e., the NC/RP ratio), in which case the variation can be carried out between the extremes of 0% and 100%. The major configuration options that this approach offers are spontaneity and duration of the IR characteristic reflected in the rise flank and the jet duration, as a result of which the invention offers the capability for configuration of the jet characteristic of the IR decoy target by the variable proportions of NC and RP. A desired IR curve can be achieved for the decoy target between the two extremes (100% NC/0% RP and 100% RP/0% NC) even in a continuously variable manner by variation of the active mass proportions from in each case 0% to 100%, for the geometric and spatial distribution.

The NC active masses can themselves be caused to react at ambient pressure (normal atmosphere). Therefore, they do not require any additional activation energy.

As is known, the active masses are kept in shape by a film sheet, or the like. Better protection against environmental influences during storage, transportation and handling is now achieved by the use of an active body casing/active body container, which burns away without any residue. This combustible casing is preferably based on NC. The combustibility ensures that no casing residues are left. In a development of the inventive idea, a type of ignition transmission layer is included, which is used to optimize the ignition transmission between the active body casing and the active masses.

Thus, in accordance with the present invention, a munitions-free, non-pyrophoric IR decoy target is proposed, based on NC and/or RP, which can be activated by alternative ignition concepts, such as a laser, high temperature, induction, etc. The stacked individual flares automatically break up after activation.

BRIEF SUMMARY OF THE DRAWINGS

The invention will be explained in more detail using at least one exemplary embodiment and the following drawings, in which:

FIG. 1 schematically illustrates an active body composed of individual flares, FIG. 2 shows an active body, consisting of NC/RP individual flares without a casing.

DETAILED DESCRIPTION OF THE INVENTION

Figure 3:
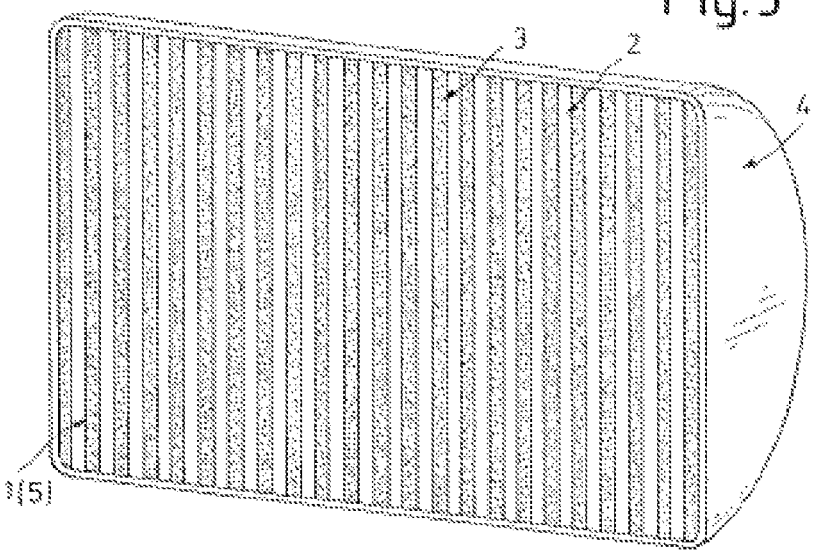
FIG. 3 shows the active body from FIG. 2 with a casing.

FIG. 1 shows a schematic illustration of an active body 1 consisting of so-called individual flares 10. FIG. 2 shows active masses 5 of an active body, which is annotated 1, and is formed from stacked flares 2, 3. In this case, by way of example and preferably, the flares 2, 3 are stamped NC and RP flare disks, respectively, although they do not necessarily need to be circular. Other surface geometries for the flares 2, 3 are likewise possible. The flares 2, 3 are combined in variable proportions. The respective proportions may be varied from about 0% to about 100%. This makes it possible to control the IR jet characteristic of the active body 1. The flares 2, 3 can be stacked alternately, but need not be. It would be possible to use a stacking sequence of a flare 2, always alternating with a flare 3, or else two flares 2 and only one flare 3 thereon, or else two flares 3 and only one flare 3 thereon, etc. (not illustrated in any more detail). In some embodiments of the present invention, the active body includes only nitrocellulose flares 2 or only red phosphorus flares 3. Because this may be the case, in some embodiments whereas other embodiments include combinations of nitrocellulose flares 2 and red phosphorus flares 3, the respective proportions of nitrocellulose flares 2 to red phosphorus flares 3 can be varied from 0% to 100%, and vice versa.

The individual flare disks 2, 3, which have been stacked in this way, are now incorporated in a container or a casing 4 (See FIG. 3). This container 4 is preferably composed of NC material, for example, NC paper, NC lacquer, and protects the actual active mass 5 (i.e., individual flares 2, 3), in particular against environmental influences. The choice of the material allows the container 4 to burn away completely, and this is likewise ignited when the active body 1 is activated.

By way of example, the active body 1 is activated on a laser basis, thermally etc., with the aid of a so-called ejection tube or the like, for example, as in an application submitted in parallel by the same applicant entitled "Activation unit for explosive masses and explosive bodies," namely, U.S. patent application Ser. No. 13/291,281 to which reference is hereby made, and which is incorporated herein by reference for all that it discloses. Thus, in accordance with the present invention, the active body 1 is activated by a laser, or is thermally activated, etc., by an ejection tube, such as the one disclosed in the application entitled "Activation unit for explosive masses and explosive bodies" (U.S. patent application Ser. No. 13/291,281).

In order to optimize the ignition, the active mass 5 and/or the container 4 of the active body 1 of present invention can be blackened (i.e., colored, for example, to the color black), which ensures that more energy is introduced to the active mass by scattering of the absorption level (laser absorption, for example). It is likewise possible to add additives to the active mass 5 and/or the container 4 in order to optimize ignition of the active mass 5. Thus, in accordance with the present invention, ignition parameters of the container are adjusted by coloring the container, or by addition of additives to a material of the container, such as by including nitrocellulose paper or nitrocellulose lacquer, etc. as a component of the material of the container, or by both coloring the container and the addition of additives to the material of the container, in order to optimize energy absorption by the container. In this way, it is possible to optimize one or more ignition parameters of the container 4 and the active mass 5 held within the container 4. In accordance with the present invention, it is also possible to blacken the active mass 5 and/or to add additives to the active mass 5 in order to optimize one or more ignition parameters of the active mass 5.

Figure 4:
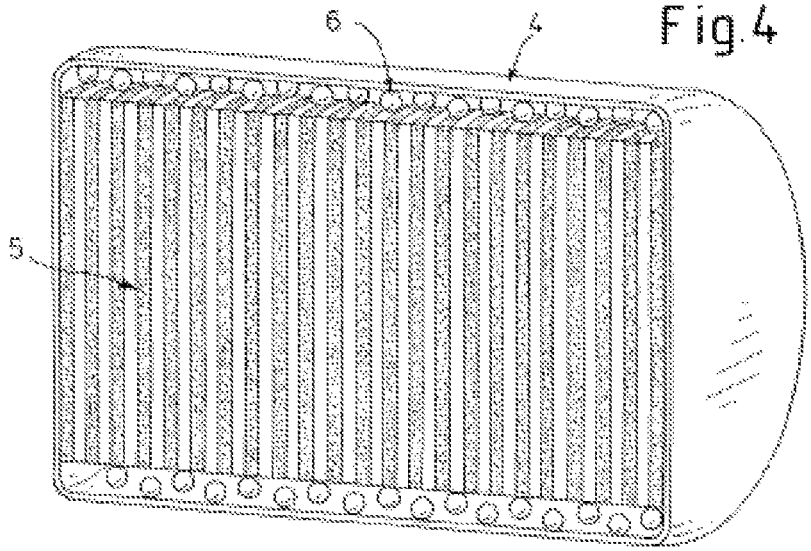
FIG. 4 shows the active body from FIG. 2 with an intermediate layer included and a casing.

If optimization of the firing chain is desirable, an intermediate layer 6 can be included between the container 4 and the active mass 5 (See FIG. 4). This structure then makes it possible to control the firing transmission, for example, to speed it up. The intermediate layer 6 should, in this case, consist of NC granulate and/or RP granulate.

Figure 5:
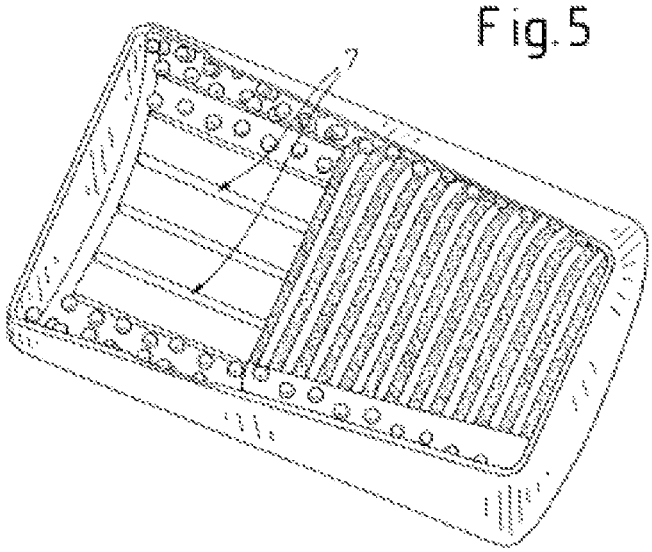
FIG. 5 shows the active body from FIG. 3 with weak points formed in the casing.

Additional weak points 7 (See FIG. 5) in the container 4 are likewise used to break the active body 1 up optimally in order to form a decoy target after activation/deployment, and are used to optimize blooming behavior of the decoy target. Weak points such as these are already known from so-called explosive projectiles.

The invention claimed is:

1. An active body comprising:

(a) an active mass comprising a plurality of flares that are arranged or stacked one behind the other and that are ignitable to produce decoy targets, wherein the plurality of flares include one or more nitrocellulose individual flares and one or more red phosphorus individual flares that are stacked in sequence so that at least one red phosphorus individual flare comes to rest on at least one nitrocellulose individual flare; and (b) a container that holds the active mass therein, and wherein the active body is munitions-free, non-pyrophoric, and produces an infrared jet when ignited.

2. The active body as claimed in claim 1, wherein ignition parameters of the container are adjusted by coloring the container, or by addition of additives to a material of the container, or by both coloring the container and the addition of additives to the material of the container, in order to optimize energy absorption by the container.

3. The active body as claimed in claim 2, wherein an intermediate layer is included in the container and is disposed between the active mass and the container.

4. The active body as claimed in claim 3, wherein the intermediate layer comprises nitrocellulose granulate, or red phosphorus granulate, or a mixture of nitrocellulose granulate and red phosphorus granulate.

5. The active body as claimed in claim 1, wherein an intermediate layer is included in the container and is disposed between the active mass and the container.

6. The active body as claimed in claim 5, wherein the intermediate layer comprises nitrocellulose granulate, or red phosphorus granulate, or a mixture of nitrocellulose granulate and red phosphorus granulate.

7. The active body as claimed in claim 1, wherein the container includes a plurality of additional weak points formed in the container.

8. The active body as claimed in claim 1, wherein the one or more nitrocellulose individual flares and the one or more red phosphorus individual flares are stacked uniformly in sequence.

9. The active body as claimed in claim 1, wherein the one or more nitrocellulose individual flares and the one or more red phosphorus individual flares are stacked non-uniformly in sequence.

10. The active body as claimed in claim 1, wherein the proportions of nitrocellulose individual flares and red phosphorus individual flares in the stacked sequence of the active mass varies from about 0% to about 100%.

11. The active body as claimed in claim 1, wherein the proportions of red phosphorus individual flares and nitrocellulose individual flares in the stacked sequence of the active mass varies from about 0% to about 100%.

12. An active body comprising:

(a) an active mass comprising a plurality of flares that are arranged or stacked one behind the other and that are ignitable to produce decoy targets, wherein the plurality of flares include one or more nitrocellulose individual flares and one or more red phosphorus individual flares that are stacked in sequence so that a plurality of nitrocellulose individual flares follow a plurality of red phosphorus individual flares, or vice versa; and (b) a container that holds the active mass therein, and wherein the active body is munitions-free, non-pyrophoric, and produces an infrared jet when ignited.

13. The active body as claimed in claim 12, wherein ignition parameters of the container are adjusted by coloring the container, or by addition of additives to a material of the container, or by both coloring the container and the addition of additives to the material of the container, in order to optimize energy absorption by the container.

14. The active body as claimed in claim 13, wherein an intermediate layer is included in the container and is disposed between the active mass and the container.

15. The active body as claimed in claim 14, wherein the intermediate layer comprises nitrocellulose granulate, or red phosphorus granulate, or a mixture of nitrocellulose granulate and red phosphorus granulate.

16. The active body as claimed in claim 12, wherein an intermediate layer is included in the container and is disposed between the active mass and the container.

17. The active body as claimed in claim 16, wherein the intermediate layer comprises nitrocellulose granulate, or red phosphorus granulate, or a mixture of nitrocellulose granulate and red phosphorus granulate.

18. The active body as claimed in claim 12, wherein the container includes a plurality of additional weak points formed in the container.

19. The active body as claimed in claim 12, wherein the plurality of nitrocellulose individual flares and the plurality of red phosphorus individual flares are stacked uniformly in sequence.

20. The active body as claimed in claim 12, wherein the plurality of nitrocellulose individual flares and the plurality of red phosphorus individual flares are stacked non-uniformly in sequence.

21. The active body as claimed in claim 12, wherein the proportions of nitrocellulose individual flares and red phosphorus individual flares in the stacked sequence of the active mass varies from about 0% to about 100%.

22. The active body as claimed in claim 12, wherein the proportions of red phosphorus individual flares and nitrocellulose individual flares in the stacked sequence of the active mass varies from about 0% to about 100%.

23. An active body comprising:

(a) an active mass comprising a plurality of flares that are arranged or stacked one behind the other and that are ignitable to produce decoy targets, wherein the plurality of flares are nitrocellulose and red phosphorus individual flares that are stacked uniformly or non-uniformly in sequence so that a red phosphorous individual flare comes to rest on a nitrocellulose individual flare, and a plurality of nitrocellulose individual flares follow one another or a plurality of red phosphorus individual flares follow one another, in order to vary a proportion of nitrocellulose and red phosphorous in the active body from about 0% to about 100%, or in order to vary a proportion of red phosphorous and nitrocellulose in the active body from about 0% to about 100%; and (b) a container that holds the active mass therein, and wherein the active body is munitions-free, non-pyrophoric, and produces an infrared jet when ignited.

* * * * *